US007308720B1

(12) United States Patent
Lilova

(10) Patent No.: US 7,308,720 B1
(45) Date of Patent: Dec. 18, 2007

(54) MULTI-POSITIONABLE HEADWEAR SYSTEM

(76) Inventor: Inna Lilova, 12227 Spottswood Dr., Riverview, FL (US) 33569

( * ) Notice: Subject to any disclaimer, the term of this patent is extended or adjusted under 35 U.S.C. 154(b) by 0 days.

(21) Appl. No.: 11/715,641

(22) Filed: Mar. 8, 2007

(51) Int. Cl.
*A42B 1/04* (2006.01)

(52) U.S. Cl. ..... 2/202

(58) Field of Classification Search ..... 2/84, 2/209.11, 209.12, 174, 202, 206; 132/273
See application file for complete search history.

(56) References Cited

U.S. PATENT DOCUMENTS 2,112,774 A * 3/1938 Thorman ..... 2/209.11
2,820,227 A * 1/1958 Wiener ..... 2/204
3,080,566 A * 3/1963 Neumann ..... 2/91
3,084,346 A * 4/1963 Stelter ..... 2/84
4,870,707 A * 10/1989 Hayes ..... 2/207
5,745,921 A 5/1998 Mitchell
6,560,784 B2 5/2003 Hill
7,010,815 B2 3/2006 Tufano-Siska

* cited by examiner

*Primary Examiner*—Katherine Moran
(74) *Attorney, Agent, or Firm*—Edward P. Dutkiewicz

(57) ABSTRACT

A plurality of panels. Each panel has a leading and trailing edge with side edges. Each panel has a central section with side sections. Forward and rearward triangular sections have apexes formed adjacent to the side edges of the panels. Coupling components are attached to the apexes. The coupling components are adapted to be coupled at any of a plurality locations with respect to a head of a wearer.

1 Claim, 4 Drawing Sheets

FIG 3
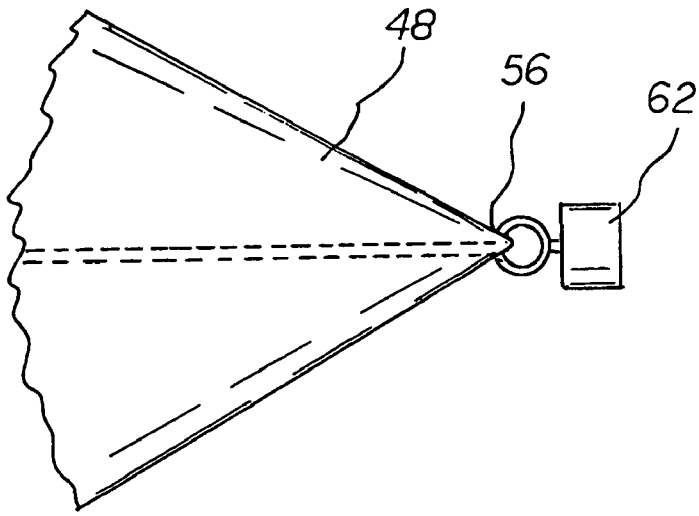
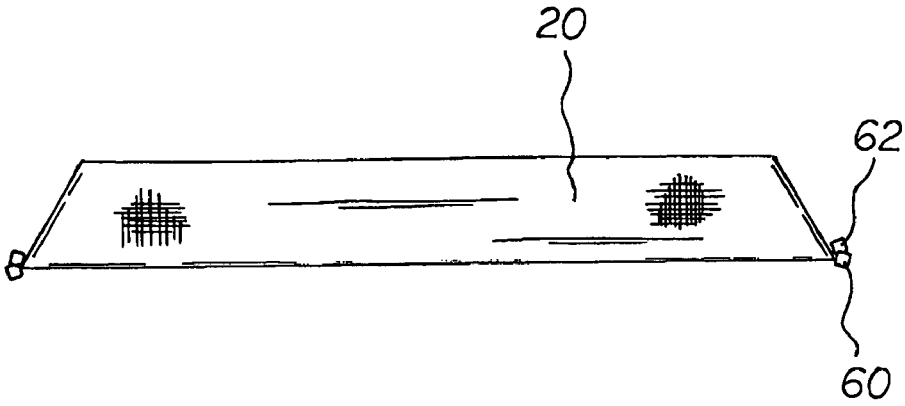
FIG 4

FIG 5
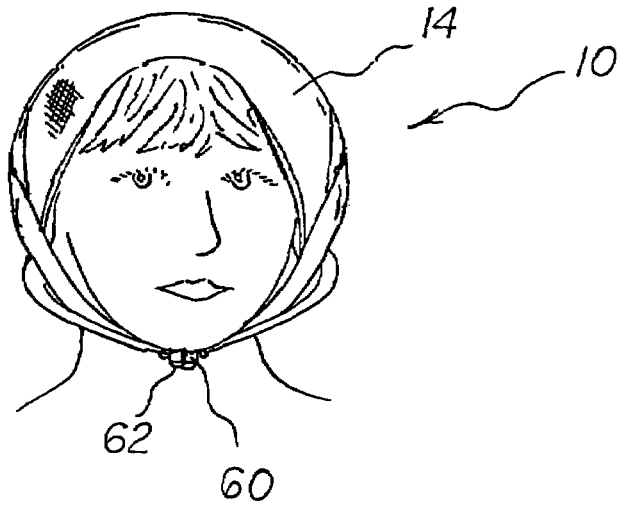
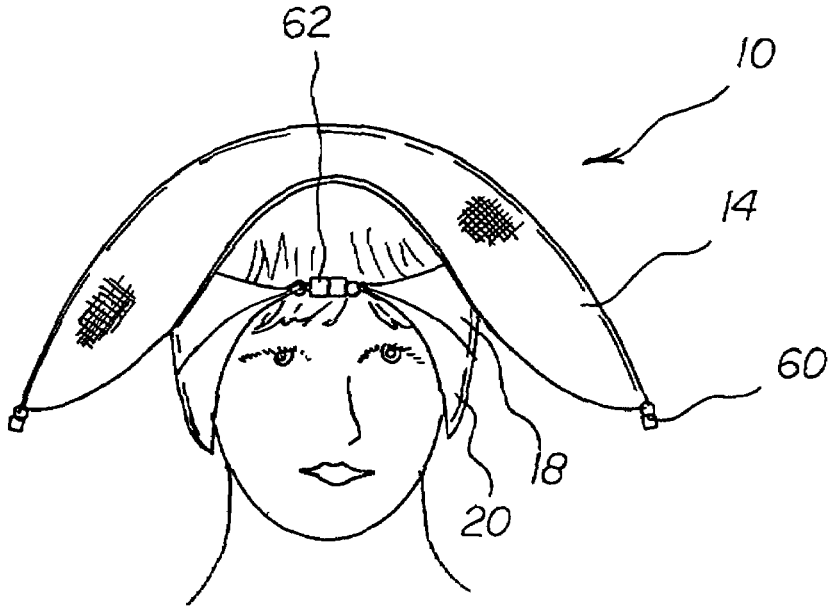
FIG 6

MULTI-POSITIONABLE HEADWEAR SYSTEM

BACKGROUND OF THE INVENTION

1. Field of the Invention

The present invention relates to a multi-positionable headwear system and more particularly pertains to covering a wearer's head in any of a plurality of orientations in a comfortable and stylish manner.

2. Description of the Prior Art

The use of headwear systems of known designs and configurations is known in the prior art. More specifically, headwear systems of known designs and configurations previously devised and utilized for the purpose of covering the head of a wearer through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 7,010,815 issued Mar. 14, 2006 to Tufano-Siska relates to a Cap for Encircling Wearer's Hair. U.S. Pat. No. 6,560,784 issued May 13, 2003 to Hill relates to a Multi-Layered Moisture Resistant Hair Wrap. Lastly, U.S. Pat. No. 5,745,921 issued May 5, 1998 to Mitchell relates to a Moisture Transferring Sweat Band.

While these devices fulfill their respective, particular objectives and requirements, the aforementioned patents do not describe a multi-positionable headwear system that allows covering a wearer's head in any of a plurality of orientations in a comfortable and stylish manner.

In this respect, the multi-positionable headwear system according to the present invention substantially departs from the conventional concepts and designs of the prior art, and in doing so provides an apparatus primarily developed for the purpose of covering a wearer's head in any of a plurality of orientations in a comfortable and stylish manner.

Therefore, it can be appreciated that there exists a continuing need for a new and improved multi-positionable headwear system which can be used for covering a wearer's head in any of a plurality of orientations in a comfortable and stylish manner. In this regard, the present invention substantially fulfills this need.

SUMMARY OF THE INVENTION

In view of the foregoing disadvantages inherent in the known types of headwear systems of known designs and configurations now present in the prior art, the present invention provides an improved multi-positionable headwear system. As such, the general purpose of the present invention, which will be described subsequently in greater detail, is to provide a new and improved multi-positionable headwear system and method which has all the advantages of the prior art and none of the disadvantages.

To attain this, the present invention essentially comprises a multi-positionable headwear system. First provided is a plurality of similarly configured rectangular panels. The panels include a first panel, a second panel, a third panel and a fourth panel. Each panel has a leading edge. Each panel has a parallel trailing edge. Each panel has first and second side edges. The side edges extend between the leading and trailing edges. The panels are fabricated of knitted elastic yarn. Each leading and trailing edge is a selvedge edge about 16 inches long plus or minus 10 percent. Each side edge is a raw edges about 3 inches long plus or minus 10 percent.

Each panel has an interior surface, an exterior surface, and a central section. The central section is about 8 inches long between the side edges. Each panel has rectangular side sections. The side sections are about 4 inches long. The side sections are provided between the central section and side sections.

Central overcast stitching is provided. The stitching is about 8 inches long. The stitching couples the central sections of the second and third panels on the interior surfaces. Additional overcast stitching is provided. The stitching is about 16 inches long. The stitching couples the first and second panels and connection the third and fourth panels on the interior surfaces.

Forward triangular sections are provided. The forward triangular sections are provided adjacent to the side edges of the first and second panels formed of the side sections of the first and second panels. Forward edge overcast stitching is provided. The stitching is provided along the side edges of the first and second panels on the interior surfaces. Rearward triangular sections are provided. The rearward triangular sections are provided adjacent to the side edges of the third and fourth panels formed of the side sections of the third and fourth panels. Rearward edge overcast stitching is provided. The stitching is provided along the side edges of the third and fourth panels on the interior surfaces.

Forward apexes are formed at the juncture of the overcast stitching between the first and second panels and the overcast stitching at the side edges of the first and second panels. Rearward apexes are formed at the juncture of the overcast stitching between the third and fourth panels and the overcast stitching at the side edges of the third and fourth panels.

Provided last are coupling components. The coupling components include cylindrical forward magnets. The magnets are attached to forward apexes. The magnets are adapted to be coupled at any of a plurality locations with respect to a head of a wearer. The coupling components also include cylindrical rearward magnets. The magnets are attached to rearward apexes. The magnets are adapted to be coupled at any of a plurality locations with respect to a head of a wearer, and independent of the locations of the forward magnets.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-positionable headwear system which has all of the advantages of the prior art headwear systems of known designs and configurations and none of the disadvantages.

It is another object of the present invention to provide a new and improved multi-positionable headwear system which may be easily and efficiently manufactured and marketed.

It is further object of the present invention to provide a new and improved multi-positionable headwear system which is of durable and reliable constructions.

An even further object of the present invention is to provide a new and improved multi-positionable headwear system which is susceptible of a low cost of manufacture with regard to both materials and labor, and which accordingly is then susceptible of low prices of sale to the consuming public, thereby making such multi-positionable headwear system economically available to the buying public.

Even still another object of the present invention is to provide a multi-positionable headwear system for covering a wearer's head in any of a plurality of orientations in a comfortable and stylish manner.

Lastly, it is an object of the present invention to provide a new and improved multi-positionable headwear system. A plurality of panels are provided. Each panel has a leading and trailing edge with side edges. Each panel has a central section with side sections. Forward and rearward triangular sections have apexes formed adjacent to the side edges of the panels. Coupling components are attached to the apexes. The coupling components are adapted to be coupled at any of a plurality locations with respect to a head of a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary and preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged illustration of one end of the system taken at circle 3 of FIG. 1.

FIG. 4 is a plan view of the exterior surface of a multi-positionable headwear system in a folded orientation.

FIGS. 5 and 6 are similarly configured illustrations, front elevational views of the system of the prior Figures on a wearer's head in two of the many different ways of wearing the system.

The same reference numerals refer to the same parts throughout the various Figures.

DESCRIPTION OF THE PREFERRED EMBODIMENT

Figure 1:
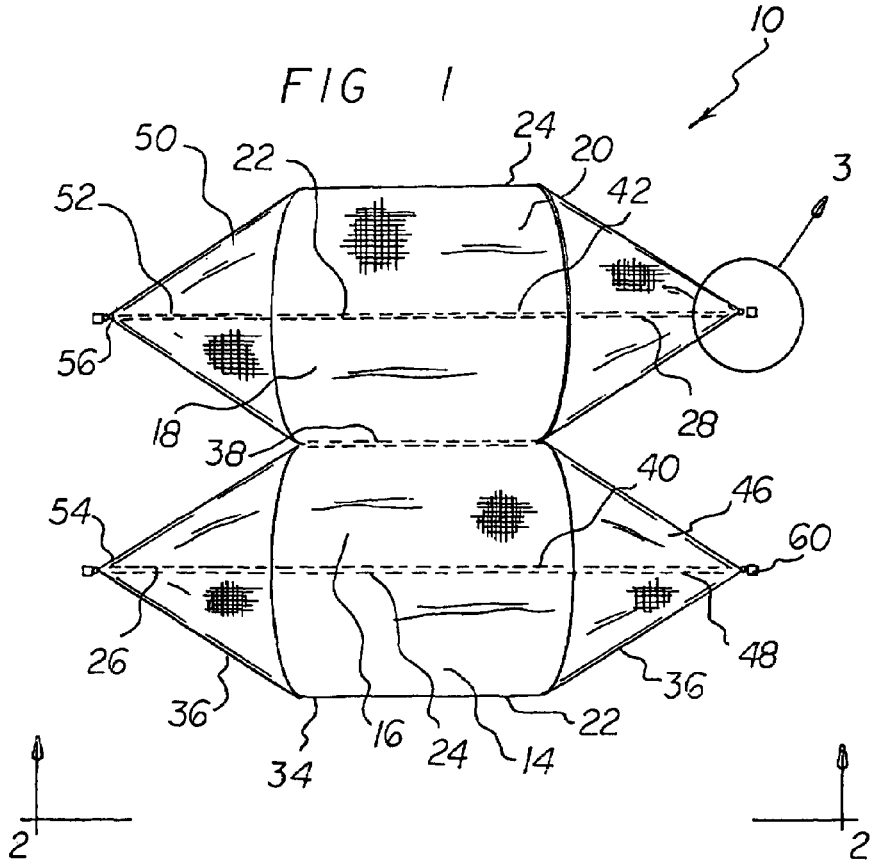
FIG. 1 is a plan view of the interior surface of a multi-positionable headwear system in an unfolded orientation constructed in accordance with the principles of the present invention.
Figure 2:
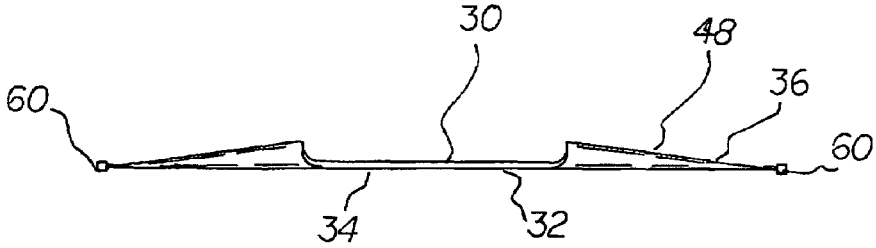
FIG. 2 is an end elevational view of the system taken along line 2-2 of FIG. 1.

With reference now to the drawings, and in particular to FIG. 1 thereof, the preferred embodiment of the new and improved multi-positionable headwear system embodying the principles and concepts of the present invention and generally designated by the reference numeral 10 will be described.

The present invention, the multi-positionable headwear system 10 is comprised of a plurality of components. Such components in their broadest context include four similarly configured panels, forward triangular sections and coupling components. Such components are individually configured and correlated with respect to each other so as to attain the desired objective.

First provided is a plurality of similarly configured rectangular panels. The panels include a first panel 14, a second panel 16, a third panel 18 and a fourth panel 20. Each panel has a leading edge 22. Each panel has a parallel trailing edge 24. Each panel has first and second side edges 26, 28. The side edges extend between the leading and trailing edges. The panels are fabricated of knitted elastic yarn. Each leading and trailing edge is a selvedge edge about 16 inches long plus or minus 10 percent. Each side edge is a raw edges about 3 inches long plus or minus 10 percent. Each panel has an interior surface 30, an exterior surface 32, and a central section 34. The central section is about 8 inches long between the side edges. Each panel has rectangular side sections 36. The side sections are about 4 inches long. The side sections are provided en the central section and side sections.

Central overcast stitching 38 is provided. The stitching is about 8 inches long. The stitching couples the central sections of the second and third panels on the interior surfaces. Additional overcast stitching 40, 42 is provided. The stitching is about 16 inches long. The stitching couples the first and second panels and connection the third and fourth panels on the interior surfaces.

Forward triangular sections 46 are provided. The forward triangular sections are provided adjacent to the side edges of the first and second panels formed of the side sections of the first and second panels. Forward edge overcast stitching 48 is provided. The stitching is provided along the side edges of the first and second panels on the interior surfaces. Rearward triangular sections 50 are provided. The rearward triangular sections are provided adjacent to the side edges of the third and fourth panels formed of the side sections of the third and fourth panels. Rearward edge overcast stitching 52 is provided. The stitching is provided along the side edges of the third and fourth panels on the interior surfaces.

Forward apexes 54 are formed at the juncture of the overcast stitching between the first and second panels and the overcast stitching at the side edges of the first and second panels. Rearward apexes 56 are formed at the juncture of the overcast stitching between the third and fourth panels and the overcast stitching at the side edges of the third and fourth panels.

In the primary embodiment, the panels are described as being preferably fabricated of a knitted elastic yarn. It should be understood that other fabrics, knitted, non-knitted, woven or the like, including elastic and non-elastic yarn including cotton, wool, silk, polyester, denim, nylon and the like constitute alternate embodiments of the invention. Further, the plurality panels, four in the primary embodiment, could be of a different number of panels, and are adapted to be of a common color or different colors or combinations thereof.

Provided last are coupling components. The coupling components include cylindrical forward magnets 60. The magnets are attached to forward apexes through rings. The magnets are adapted to be coupled at any of a plurality locations with respect to a head of a wearer. The coupling components also include cylindrical rearward magnets 62. The magnets are attached to rearward apexes. The forward magnets and the rearward magnets are adapted to be coupled at any of a plurality locations with respect to a head of a wearer, forwardly or rearwardly, higher or lower, and independent of the locations of the forward magnets. Magnets are disclosed as the preferred coupling components. It should be understood that other coupling components including snaps, hook and eyes, buttons, hook and loop fasteners such as Velcro, and the like constitute alternate embodiments of the invention.

Figure 7:
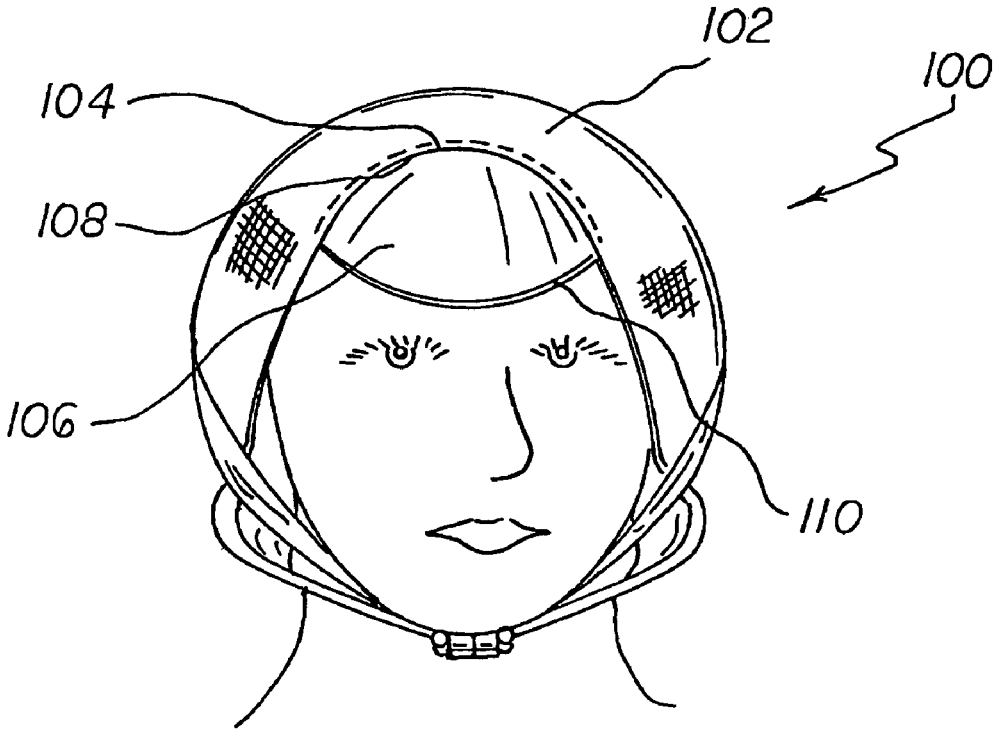
FIG. 7 is a front elevational similar to FIG. 5 but illustrating an alternate embodiment of the invention.

FIG. 7 is a front elevational view similar to FIG. 5 but illustrating a multi-positional headwear system 100 constructed in accordance with an alternate embodiment of the invention. In such alternate embodiment, the panels and related components are essentially the same as in the primary embodiment described above. The system 100 includes a front panel 102 with a forward edge 104. A visor 106, however, is additionally provided and is formed with a rearward edge 108 coupled with the forward edge of the front panel, preferably by stitching. The visor extends forwardly from the front panel terminating at a leading edge 110 functioning to shield the eyes of a wearer from the harmful rays of the sun. The visor is preferably fabricated of a conventional material with limited flexibility.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-positionable headwear system for covering a wearer's head in any of a plurality of orientations in a comfortable and stylish manner comprising, in combination:

a plurality of similarly configured rectangular panels including a first panel and a second panel and a third panel and a fourth panel, each panel having a leading edge and a parallel trailing edge with first and second side edges extending between the leading and trailing edges, the panels being fabricated of knitted elastic yarn with each leading and trailing edge being a selvedge edge about 16 inches long plus or minus 10 percent and each side edge being a raw edges about 3 inches long plus or minus 10 percent, each panel having an interior surface and an exterior surface with a central section about 8 inches long between the side edges with rectangular side sections about 4 inches long between the central section and side sections, central overcast stitching about 8 inches long coupling the central sections of the second and third panels on the interior surfaces with additional overcast stitching about 16 inches long coupling the first and second panels and connection the third and fourth panels on the interior surfaces;

forward triangular sections adjacent to the side edges of the first and second panels formed of the side sections of the first and second panels with forward edge overcast stitching along the side edges of the first and second panels on the interior surfaces, rearward triangular sections adjacent to the side edges of the third and fourth panels formed of the side sections of the third and fourth panels with rearward edge overcast stitching along the side edges of the third and fourth panels on the interior surfaces, forward apexes formed at the juncture of the overcast stitching between the first and second panels and the overcast stitching at the side edges of the first and second panels, rearward apexes formed at the juncture of the overcast stitching between the third and fourth panels and the overcast stitching at the side edges of the third and fourth panels; and coupling components including cylindrical forward magnets attached to forward apexes and adapted to be coupled at any of a plurality locations with respect to a head of a wearer, the coupling components also including cylindrical rearward magnets attached to rearward apexes and adapted to be coupled at any of a plurality locations with respect to a head of a wearer, and independent of the locations of the forward magnets.

* * * * *